US009420888B1

(12) United States Patent
Evans et al.

(10) Patent No.: US 9,420,888 B1
(45) Date of Patent: Aug. 23, 2016

(54) GRAVERSE CHAIR

(71) Applicants: Robert Evans, Sudbury, MA (US); Troy Morgan, Sudbury, MA (US)

(72) Inventors: Robert Evans, Sudbury, MA (US); Troy Morgan, Sudbury, MA (US)

( * ) Notice: Subject to any disclaimer, the term of this patent is extended or adjusted under 35 U.S.C. 154(b) by 258 days.

(21) Appl. No.: 14/014,919

(22) Filed: Aug. 30, 2013

Related U.S. Application Data

(60) Provisional application No. 61/694,939, filed on Aug. 30, 2012.

(51) Int. Cl.
*A47C 3/00* (2006.01)
*A47C 7/38* (2006.01)

(52) U.S. Cl.
CPC .. *A47C 3/00* (2013.01); *A47C 7/38* (2013.01)

(58) Field of Classification Search
CPC ..... B60N 2/449; A47C 9/025
USPC ..... 297/284.3, 284.4, 284.9
See application file for complete search history.

(56) References Cited

U.S. PATENT DOCUMENTS 4,187,869 A * 2/1980 Marchetti ..... 135/67
5,582,464 A * 12/1996 Maymon ..... A47C 7/70 297/173
7,350,863 B2 * 4/2008 Engels et al. ..... 297/284.11
7,628,455 B2 * 12/2009 Brodeur ..... 297/423.1

* cited by examiner

*Primary Examiner* — Sarah McPartlin
(74) *Attorney, Agent, or Firm* — Anderson Gorecki & Rouille LLP

(57) ABSTRACT

A graverse chair is presented. The chair includes a stationary base and a pedestal in mechanical communication with the stationary base. The chair includes a movable base section in mechanical communication with the stationary base. The movable base section comprises a descending contact base in mechanical communication with a fixed base by way of at least one resistance guide. The chair additionally includes at least one load transfer device in mechanical communication with the movable base, which is capable of rotating when the movable base is compressed. The chair includes at least one pad rod in communication with the load transfer device, the pad rod moving in at least one direction when the load transfer device rotates, and at least one torso pad in mechanical communication with the pad rod, wherein the torso pad is capable of providing support for a user when a user sits in the chair.

17 Claims, 3 Drawing Sheets

GRAVERSE CHAIR

CROSS REFERENCE TO RELATED APPLICATIONS

The present application claims the benefit of U.S. Provisional Patent Application No. 61/694,939, filed on Aug. 30, 2012, which is incorporated herein by reference in its entirety.

BACKGROUND

Since the advent of the modern chair there have been many attempts to make the continuous daily use of the chair a less stressful condition for the human body. Many notable improvements include the ergonomic form of the chair to high tech cushions and pads. Other designs include the use of redirecting the natural stress points from the seated form to the kneeling form to help with vascular activity and joint stress. All of these efforts are unique in their design but are similar in their use of their lowest load bearing body part accepting all or most of their body's weight. The significant impact of the repetitive and continuous use of the modern chair vary widely on the type, size and quality of the chairs manufacture and design, however ultimately they all produce the same deleterious effects on the human body, vascular system and form.

SUMMARY

Conventional mechanisms such as those explained above suffer from a variety of deficiencies. One such deficiency is that the natural tendency of the standard L-form chair to impart the majority load on the gluteus maximums and hamstring/back of the legs, which creates such conditions as poor circulation to the lower extremities, contributes to the formation of such conditions as hemorrhoids and thrombosis or conditions which commonly lead to acute conditions such as Deep Vein Thrombosis (DVT) where the blood vessels become constricted for extended periods of time making for ideal blood clotting environments. In any and all forms of the L-Form chair the emphasis is placed on the distribution of the load, spreading out the gross mass of the individual by as large an area as possible, this is done by using such cushions and pads as memory foams and specialty pads which accept and form around the seat of the person making increased surface contact to reduce the overall load density on any single part of the individual. Other complications which arise from the standard L-Form chair come from the passive supports provided by the design of the chair, in which the occupant of the chair is required to consciously maintain the proper seated form to derive any benefits from the chair, i.e. the seated person must actively keep proper posture and position in or on the chair to take advantage of its benefits. There is nothing in the inherent design of the chair which removes the responsibility of the individual to create the proper form; it is incumbent on the individual.

In other designs the chair creates a kneeling position to keep the seated person in an erect form allowing for natural vertical positions to be kept during times of use. This locates the majority load on a skeletally protected region of the body, the knees and the shins, with stabilizing negligible support from the back of the seated person's legs.

If the individual using any customary chair design has an acute mal-condition which arrives from skeletal loading, vascular irregularity or misalignment issues to name a few, the customary design offers little if no relief. The loading condition will still be present, the vascular issue would not be improved by these designs and would likely be aggravated further with continued persistent use.

Embodiments of the invention significantly overcome such deficiencies. With the present invention the conditions noted above will be alleviated. The use of the new design would eliminate the massive loading effect on the lowest form of the seated individual, by actively supporting the occupant by an elevated skeletal position on the body, in most instances of the present invention this would be the rib cage behind the chest or directly below the shoulders near or under the arm pits, and inherently a low density vascular region. This would dramatically reduce the load on the gluteus maximus and hamstring region of the legs. The present invention would allow for varying levels of load relief allowing the individual to set the desired load relief of their liking, allowing for a preventative continuous use as a daily chair or as a rehabilitation aid in the relief and remediation of acute conditions. The present invention employs several active motion and stationary components to accommodate the variety of conditions associated with being seated. By having a stationary fixed base, a secondary descending contact base, mechanical armatures and segments which support and/or convey the torso support pads, optional lumbar and optional neck supports the present inventions disposes with the customary product design shortcomings.

One representation of present invention in part or full, uses the individual's weight to impart a counter force on the user's upper body. This is accomplished by several modes, moving the torso supports into position and allowing the descending contact base to lower during the occupants seating motion, whereby the descending contact base's resistive mechanisms provide some or full support to the seat of the individual. In another embodiment the torso pads are used in a counter load motion, compressed and raised by the effects of the armatures attached to the descending contact base affixed to the stationary fixed base. Another mode of accomplishing this support is by using the effects of the support pads located on or around the torso below shoulders to support the seated body's weight by suspending the load from the location of the support pads.

Another embodiment of the present invention uses the support pads in a fixed location to provide support from under the arm or around the torso of the seated occupant. This entails a fixed seat base or pan and a passive acceptance of the load from the seated occupant. Using the natural and expected form of the occupant as the pre-determined positions of the pads and the seat pan, making for a similar experience with less costly mechanics involved in it processing and manufacture.

Still another embodiment of the present invention allows for a fixed position on the torso pads, while allowing for a moving base or seat pan. This would offer a greater degree of comfort while not sacrificing the full mechanical effects of the originally stated design, giving the chair the ability automatically equilibrate to the weight and form of the occupant while again making the processing and manufacture less costly.

In the initial representation, the present inventions torso pads are locked into a fixed position and the person will use the pads to provide gradual hybrid support, allowing the effects of gravity to lessen the load on their seated region to diminish the effects of greater load densities by allowing the torso pads to accept some or all of the occupants weight.

In the second form, the torso pads will move upward and inward toward the individual's torso to create a firm clenching effect on the torso of the occupant. This will allow the descending contact base to equalize the effects of the load on the seat of the occupant and the torso of the occupant. Therein creating a lessened load effect on the descending contact base, and using the natural response of the descending contact base to cause the torso pads to clench and rise toward the occupant's torso.

Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
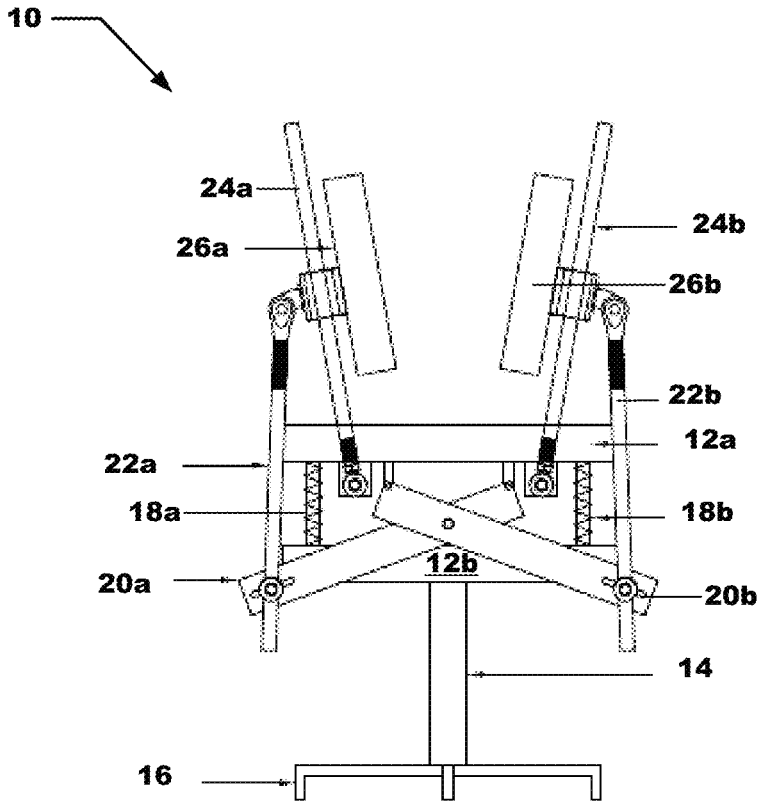
FIG. 1 comprises a drawing a first embodiment of a graverse chair in accordance with the present invention.

The embodiments set forth below represent the necessary information to enable those skilled in the art to practice the invention and illustrate the best mode of practicing embodiments of the invention. Upon reading the following description in light of the accompanying figures, those skilled in the art will understand the concepts of the invention and recognize applications of these concepts not particularly addressed herein. It should be understood that these concepts and applications fall within the scope of the disclosure and the accompanying claims.

The preferred embodiment of the invention will now be described with reference to the accompanying drawings. The invention may, however, be embodied in many different forms and should not be construed as limited to the embodiment set forth herein; rather, this embodiment is provided so that this disclosure will be thorough and complete, and will fully convey the scope of the invention to those skilled in the art. The terminology used in the detailed description of the particular embodiment illustrated in the accompanying drawings is not intended to be limiting of the invention. In the drawings, like numbers refer to like elements.

The present invention in part or full, uses the individual's weight to impart a counter force on the user's upper body. This is accomplished by two modes, moving the torso supports into position and allowing the descending contact base to lower during the occupants seating motion, whereby the descending contact base's resistive mechanisms provide some or full support to the seat of the individual. Or, secondly, the torso pads are used in a counter load motion, compressed and raised by the effects of the armatures attached to the descending contact base affixed to the stationary fixed base.

In the initial representation, the present inventions torso pads are locked into a fixed position and the person will use the pads to provide gradual hybrid support, allowing the effects of gravity to lessen the load on their seated region to diminish the effects of greater load densities by allowing the torso pads to accept some or all of the occupants weight.

In the second form, the torso pads will move upward and inward toward the individual's torso to create a firm clenching effect on the torso of the occupant. This will allow the descending contact base to equalize the effects of the load on the seat of the occupant and the torso of the occupant. Therein creating a lessened load effect on the descending contact base, and using the natural response of the descending contact base to cause the torso pads to clench and rise toward the occupant's torso.

Referring now to FIG. 1, a first particular embodiment of a graverse chair 10 is shown. Chair 10 includes a movable base which comprises a descending contact base 12*a*, fixed base 12*b* and a pair of resistance guides 18*a* and 18*b*. In this embodiment the base section is attached to a pedestal 14 which is connected to a stationary base 16.

Chair 10 further includes a pair of load transfer devices 20*a* and 2*b* connected to the descending contact base 12*a*. The load transfer devices can include, but are not limited to, armatures, pulleys and cables, bearing rods or the like. In this example the load transfer devices are armatures. Each armature 20*a* and 20*b* is connected to a respective pad rod 22*a* and 22*b*. The upper end of the pad rods 22*a* and 22*b* each include a respective torso pad 26*a* and 26*b*. A pair of torso pad support rails 24*a* and 24*b* extend from descending contact base 12*a* and support a respective torso pad 26*a* and 26*b*.

In use, when a user sits down on the movable base section, the descending contact base 12*a* will lower during the occupants seating motion, whereby the descending contact base resistive guides 18*a* and 18*b* provide some or full support to the seat of the individual. The lowering of the descending contact base 12*a* will also cause rotation of armatures 20*a* and 20*b* which results in an upward movement of pad rods 22*a* and 22*b*. This upward movement of the pad rods 22*a* and 22*b* will result in a pivoting inward of the torso pads 26*a* and 26*b* along torso pad support rails 14*a* and 24*b*, which will provide support to the upper torso of the user, thereby distributing in part the load of the user between the users lower torso and the users upper torso.

Figure 2:
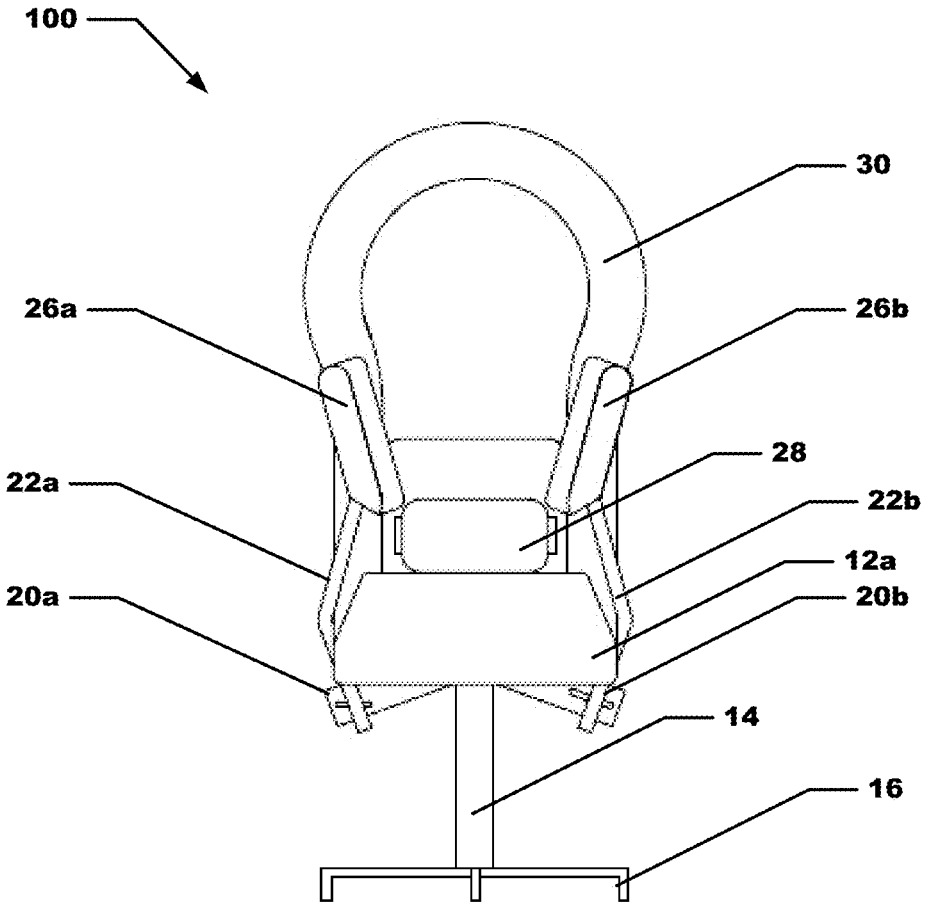
FIG. 2 is a diagram of a second embodiment of a graverse chair in accordance with the present invention.

Referring now to FIG. 2, a second particular embodiment of a graverse chair 100 is shown. Chair 100 includes a movable base which comprises a descending contact base 12*a*, a fixed base (not shown) and a pair of resistance guides (not shown). In this embodiment the base section is attached to a pedestal 14 which is connected to a stationary base 16.

Chair 10 further includes a pair of mechanical armatures 20*a* and 2*b* connected to the descending contact base 12*a*. Each armature 20*a* and 20*b* is connected to a respective pad rod 22*a* and 22*b*. The upper end of the pad rods 22*a* and 22*b* each include a respective torso pad 26*a* and 26*b*

In use, when a user sits down on the movable base section, the descending contact base 12*a* will lower during the occupants seating motion, whereby the descending contact base resistive guides provide some or full support to the seat of the individual. The lowering of the descending contact base 12*a* will also cause rotation of armatures 20*a* and 20*b* which results in an upward movement of pad rods 22*a* and 22*b*. This upward movement of the pad rods 22*a* and 22*b* will cause an upward motion of the torso pads 26*a* and 26*b*, which will provide support to the upper torso of the user, thereby distributing in part the load of the user between the user's lower torso and the user's upper torso. Also shown in this embodiment are a lumbar support 28 for supporting the lower back of the user and a neck support 30 for supporting a neck of the user.

Figure 3:
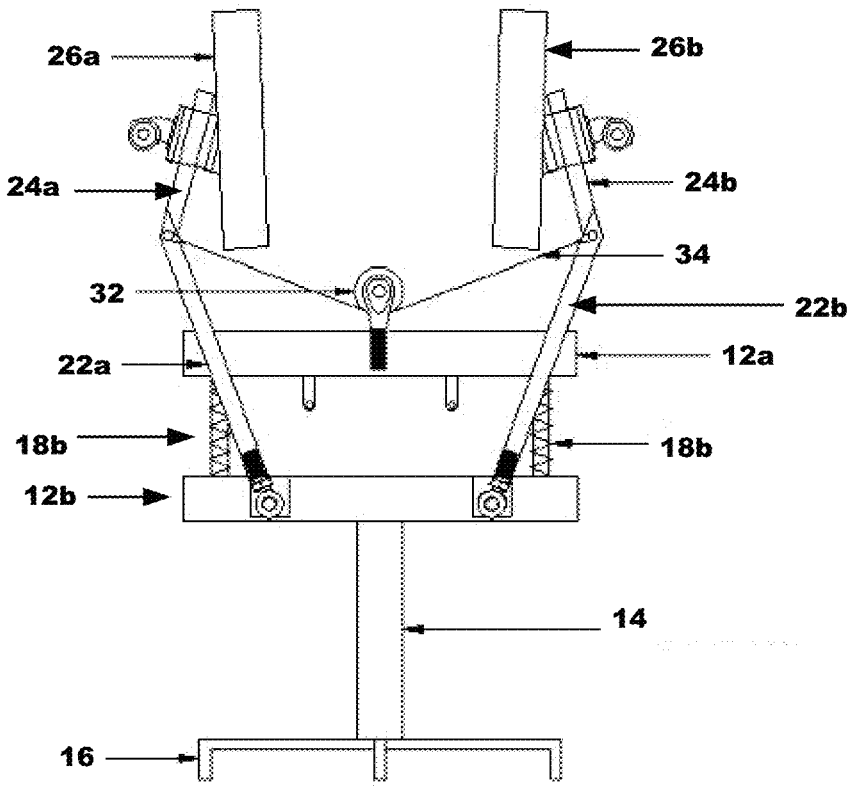
FIG. 3 is a diagram of a third embodiment of a graverse chair in accordance with the present invention.

Referring now to FIG. 3, another particular embodiment of a graverse chair 10 is shown. Chair 10 includes a movable base which comprises a descending contact base 12*a*, fixed base 12*b* and a pair of resistance guides 18*a* and 18*b*. In this embodiment the base section is attached to a pedestal 14 which is connected to a stationary base 16.

Chair 10 further pad rods 22*a* and 22*b* each of which include a respective torso pad 26*a* and 26*b*. A pair of torso pad support rails 24*a* and 24*b* extend from pad rods and support a respective torso pad 26*a* and 26*b*. Also shown is a cable 34 in communication with a pulley 32. Cable 34 extends between pad rods 22*a* and 22*b* and across pulley 32.

In use, when a user sits down on the movable base section, the descending contact base 12*a* will lower during the occupants seating motion, whereby the descending contact base resistive guides 18*a* and 18*b* provide some or full support to the seat of the individual. The lowering of the descending contact base 12*a* will also cause downward movement of the pulley 34 which results in an upward movement of pad rods 22*a* and 22*b*. This upward movement of the pad rods 22*a* and 22*b* will result in a pivoting inward of the torso pads 26*a* and 26*b* along torso pad support rails 14*a* and 24*b*, which will provide support to the upper torso of the user, thereby distributing in part the load of the user between the users lower torso and the users upper torso. In other words, the pad rods are attached to the fixed base. As the movable base descends the cables force the pads to move inward and upward for support via the pulley mechanism.

In a further embodiment the chair includes a base and a pedestal in mechanical communication with the base. The chair further includes a stationary base section in mechanical communication with the base and at least one pad rod moveable in at least one direction by a user. The chair also features at least one torso pad in mechanical communication with the pad rod, wherein the torso pad is capable of providing support for a user when a user sits in said chair.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A chair comprising:

a stationary base;

a pedestal in mechanical communication with said stationary base;

a movable base section in mechanical communication with said stationary base;

at least one load transfer device in mechanical communication with said movable base; said at least one load transfer device capable of rotating as a result of said movable base being compressed;

at least one pad rod in communication with said load transfer device, said at least one pad rod moving in at least one direction when said load transfer device rotates;

at least one torso pad in mechanical communication with said pad rod, wherein said torso pad is capable of providing support for a user when a user sits in said chair; and at least one torso pad support rail in mechanical communication with said movable base and said torso pad.

2. The chair of claim 1 wherein said movable base includes a descending contact base in mechanical communication with a fixed base by way of at least one resistance guide.

3. The chair of claim 2 wherein a resistance provided by said resistance guide is adjustable.

4. The chair of claim 1 further comprising a lumbar pad disposed in said chair above said movable base.

5. The chair of claim 1 further comprising a neck support pad disposed in said chair above said movable base.

6. The chair of claim 1 wherein said movable base section comprises a seat.

7. The chair of claim 6 wherein said seat and said at least one torso pad share weight support of a person seated in said chair.

8. The chair of claim 7 wherein an amount of weight support provided by said seat and said at least one torso pad share is adjustable.

9. The chair of claim 1 wherein said load transfer device is selected from the group comprising an armature, a pulley and cable and a bearing rod.

10. A chair comprising:

a stationary base;

a pedestal in mechanical communication with said stationary base;

a movable base section in mechanical communication with said stationary base;

at least one load transfer device in mechanical communication with said movable base said at least one load transfer device capable of rotating as a result of said movable base being compressed;

at least one pad rod in communication with said load transfer device;

at least one torso pad in mechanical communication with said pad rod, wherein said torso pad is capable of providing support for a user when a user sits in said chair; and a lumbar pad disposed in said chair above said movable base.

11. The chair of claim 10 wherein said movable base includes a descending contact base in mechanical communication with a fixed base by way of at least one resistance guide.

12. The chair of claim 11 wherein a resistance provided by said resistance guide is adjustable.

13. The chair of claim 10 further comprising a neck support pad disposed in said chair above said movable base.

14. The chair of claim 10 wherein said movable base section comprises a seat.

15. The chair of claim 14 wherein said seat and said at least one torso pad share weight support of a person seated in said chair.

16. The chair of claim 15 wherein an amount of weight support provided by said seat and said at least one torso pad share is adjustable.

17. The chair of claim 10 wherein said load transfer device is selected from the group comprising an armature, a pulley and cable and a bearing rod.

* * * * *